US009047781B2

(12) United States Patent
Geter

(10) Patent No.: US 9,047,781 B2
(45) Date of Patent: Jun. 2, 2015

(54) SAFETY ZONE DETECTION, ENFORCEMENT AND ALARM SYSTEM AND RELATED METHODS

(75) Inventor: Eric Geter, Stone Mountain, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 379 days.

(21) Appl. No.: 13/484,995

(22) Filed: May 31, 2012

(65) Prior Publication Data

US 2012/0306664 A1 Dec. 6, 2012

Related U.S. Application Data

(60) Provisional application No. 61/491,586, filed on May 31, 2011.

(51) Int. Cl.
*G08G 1/08* (2006.01)
*G08G 1/16* (2006.01)

(52) U.S. Cl.
CPC ..... *G08G 1/166* (2013.01)

(58) Field of Classification Search
USPC ..... 340/435, 901, 903; 342/70
See application file for complete search history.

(56) References Cited

U.S. PATENT DOCUMENTS 5,357,560 A * 10/1994 Nykerk ..... 455/404.1
6,085,151 A 7/2000 Farmer et al.
6,191,704 B1 2/2001 Takenaga et al.
6,337,637 B1 1/2002 Kubota et al.
6,624,782 B2 9/2003 Jocoy et al.
6,636,258 B2 10/2003 Strumolo
6,831,572 B2 12/2004 Strumolo et al.
RE38,870 E 11/2005 Hall
7,095,336 B2 8/2006 Rodgers et al.
7,230,640 B2 6/2007 Regensburger et al.
2004/0252863 A1 12/2004 Chang et al.
2005/0090982 A1 4/2005 Mead et al.
2006/0187009 A1* 8/2006 Kropinski et al. ..... 340/435
2007/0126564 A1* 6/2007 Lee et al. ..... 340/435

* cited by examiner

*Primary Examiner* — Daryl Pope
(74) *Attorney, Agent, or Firm* — Myers Bigel Sibley & Sajovec, PA

(57) ABSTRACT

A system for alerting a user in a safety zone adjacent a stationary vehicle includes one or more sensors configured to generate a sensor signal in response to a detected location and/or trajectory of a moving vehicle in an encroachment zone and/or the safety zone. The encroachment zone is a region adjacent the safety zone in which vehicles are at risk of entering the safety zone. A control unit is configured to receive the signal from the one or more sensors and to determine, responsive to the sensor signals, a likelihood of the moving vehicle entering the safety zone. The control unit is further configured to generate a trigger signal if the likelihood of the moving vehicle entering the safety zone is greater than a predetermined threshold. An alarm unit is configured to receive the trigger signal from the control unit and to automatically trigger an alarm protocol when the trigger signal is received to alert the user in the safety zone.

18 Claims, 4 Drawing Sheets

SAFETY ZONE DETECTION, ENFORCEMENT AND ALARM SYSTEM AND RELATED METHODS

RELATED APPLICATIONS

This application claims priority to Application Ser. No. 61/491,586, filed May 31, 2011, the contents of which are hereby incorporated by reference as if fully set forth herein.

FIELD OF THE INVENTION

The present invention relates to location and tracking systems and methods, and in particular, to a safety zone detection, enforcement and alarm system and methods.

BACKGROUND

Highway patrol officers, emergency response teams, and other department of transportation workers and personnel are exposed to the possibilities of being struck by oncoming vehicles when stopped along the side of the highway. The life-threatening hazards involved with work near traffic may also involve a worker who has their back exposed to oncoming traffic and an inability to see a possible collision approaching while their back is turned. The resulting slower response time to avoid a vehicle approaching the worker is extremely hazardous. On a national scale, over one thousand fatalities were reported in each of the past thirteen years that were directly related to transportation work zone crashes.

Although flashing lights may be used to warn on-coming motorists, fatalities and injuries remain significant hazards for police officers, emergency response personnel, and transportation workers such as construction workers. Many states have also enacted "move over" laws that require motorists to remain a safer distance from official vehicles; however, enforcement of these laws remains difficult due to a lack of additional personnel during traffic stops.

SUMMARY

In some embodiments, a system for alerting a user in a safety zone adjacent a stationary vehicle includes one or more sensors configured to generate a sensor signal in response to a detected location and/or trajectory of a moving vehicle in an encroachment zone and/or the safety zone. The encroachment zone is a region adjacent the safety zone in which vehicles are at risk of entering the safety zone. A control unit is configured to receive the signal from the one or more sensors and to determine, responsive to the sensor signals, a likelihood of the moving vehicle entering the safety zone. The control unit is further configured to generate a trigger signal if the likelihood of the moving vehicle entering the safety zone is greater than a predetermined threshold. An alarm unit is configured to receive the trigger signal from the control unit and to automatically trigger an alarm protocol when the trigger signal is received to alert the user in the safety zone.

In some embodiments, the sensors are mounted on the stationary vehicle. In some embodiments, the sensors comprise a LIDAR sensor configured to track an object. In some embodiments, the alarm unit comprises an auditory and/or visual alarm.

In some embodiments, the trigger signal comprises an alarm trigger and the control unit is further configured to determine, responsive to the sensor signals, whether the moving vehicle has entered the safety zone, and to generate an enforcement trigger signal when the moving vehicle has entered the safety zone. An enforcement unit may be configured to receive the enforcement trigger signal from the control unit and to automatically trigger an enforcement protocol when the enforcement trigger signal is received. The enforcement unit may be configured to record an identity of a vehicle when the enforcement protocol is triggered by the control unit. The enforcement protocol may include recording a video including a license plate of the moving vehicle In some embodiments, the sensors include at least two spaced-apart optical sensors, and the sensor signal further includes a velocity of the moving vehicle based on a time that the vehicle is detected by each of the two spaced-apart optical sensors.

In some embodiments, a system for enforcing a safety zone adjacent a stationary vehicle includes one or more sensors configured to generate a sensor signal in response to a detected location and/or trajectory of a moving vehicle in an encroachment zone and/or the safety zone. The encroachment zone is a region adjacent the safety zone in which vehicles are at risk of entering the safety zone. A control unit is configured to receive the signal from the one or more sensors and to determine, responsive to the sensor signals, whether the moving vehicle has entered the safety zone. The control unit is further configured to generate a trigger signal when the moving vehicle has entered the safety zone. An enforcement unit is configured to receive the trigger signal from the control unit and to automatically trigger an enforcement protocol when the trigger signal is received.

In some embodiments, the sensors are mounted on the stationary vehicle.

In some embodiments, the sensors comprise at least two spaced-apart optical sensors, and the sensor signal further comprises a velocity of the moving vehicle based on a time that the vehicle is detected by each of the two spaced-apart optical sensors.

In some embodiments, the trigger signal comprises an enforcement trigger and the control unit is further configured to determine a likelihood of the moving vehicle entering the safety zone. The control unit is further configured to generate an alarm trigger signal if the likelihood of the moving vehicle entering the safety zone is greater than a predetermined threshold. In some embodiments, an alarm unit is configured to receive the trigger signal from the control unit and to automatically trigger an alarm protocol when the trigger signal is received to alert the user in the safety zone. In some embodiments, the alarm unit is configured to visually and/or audibly alert a user.

In some embodiments, the sensors include a LIDAR sensor configured to track an object.

In some embodiments, a method for alerting a user in a safety zone adjacent a stationary vehicle is provided. The method includes generating a sensor signal from one or more sensors in response to a detected location and/or trajectory of a moving vehicle in an encroachment zone and/or the safety zone. The encroachment zone is a region adjacent the safety zone in which vehicles are at risk of entering the safety zone. The sensor signal is received from the one or more sensors at a control unit. A likelihood of the moving vehicle entering the safety zone is determined responsive to the sensor signal. A trigger signal is generated if the likelihood of the moving vehicle entering the safety zone is greater than a predetermined threshold. An alarm protocol is automatically triggered when the trigger signal is received by an alarm unit to alert the user in the safety zone.

In some embodiments, the trigger signal is an alarm trigger signal and whether the moving vehicle has entered the safety zone is determined responsive to the sensor signals. An enforcement trigger signal is generated when the moving vehicle has entered the safety zone. In some embodiments, the enforcement trigger signal is received at an enforcement unit. An enforcement protocol is automatically triggered when the enforcement trigger signal is received.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF EMBODIMENTS OF THE INVENTION

Figure 1:
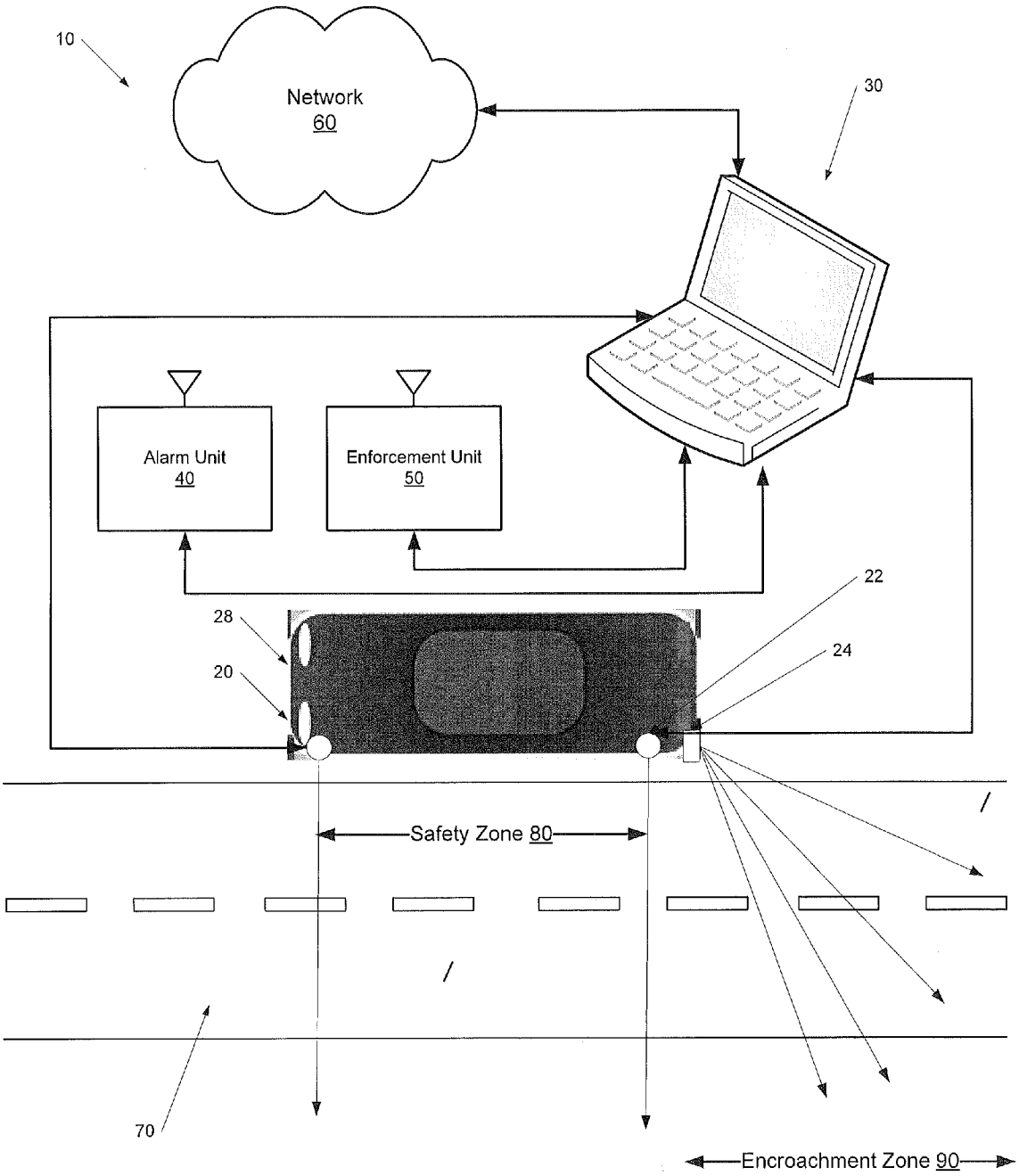
FIG. 1 is a schematic diagram of a safety zone detection, enforcement and alarm system according to some embodiments.

The present invention now will be described hereinafter with reference to the accompanying drawings and examples, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under." The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present invention. The sequence of operations (or steps) is not limited to the order presented in the claims or figures unless specifically indicated otherwise.

The present invention is described below with reference to block diagrams and/or flowchart illustrations of methods, apparatus (systems) and/or computer program products according to embodiments of the invention. It is understood that each block of the block diagrams and/or flowchart illustrations, and combinations of blocks in the block diagrams and/or flowchart illustrations, can be implemented by computer program instructions. These computer program instructions may be provided to a processor of a general purpose computer, special purpose computer, and/or other programmable data processing apparatus to produce a machine, such that the instructions, which execute via the processor of the computer and/or other programmable data processing apparatus, create means for implementing the functions/acts specified in the block diagrams and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instructions which implement the function/act specified in the block diagrams and/or flowchart block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the block diagrams and/or flowchart block or blocks.

Accordingly, the present invention may be embodied in hardware and/or in software (including firmware, resident software, micro-code, etc.). Furthermore, embodiments of the present invention may take the form of a computer program product on a computer-usable or computer-readable non-transient storage medium having computer-usable or computer-readable program code embodied in the medium for use by or in connection with an instruction execution system.

The computer-usable or computer-readable medium may be, for example but not limited to, an electronic, optical, electromagnetic, infrared, or semiconductor system, apparatus, or device. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM).

As used herein, a LIDAR ("light detection and ranging") is an optical remote sensing technology that can measure the distance to, or other properties of a target by illuminating the target with light, often using pulses from a laser.

FIG. 1 is a schematic diagram illustrating a system 10 according to some embodiments. As illustrated, the system 10 includes a front sensor 20 and a back sensor 22 and a LIDAR ("light detection and ranging") sensor 24, which are all mounted on a stationary vehicle 28. The system 10 further includes a control unit 30, an alarm unit 40, an enforcement unit 50 and a network 60. The system 10 is positioned adjacent a road 70 or other area and defines a safety zone 80 and an encroachment zone 90. For example, the vehicle 28 may be a police or other safety or emergency vehicle, and the safety zone 80 may be a region in which a user, such as a police officer, may be likely to stand when the vehicle 28 is stationary by the road 70, e.g., during a traffic stop. As illustrated, the sensors 20, 22, 24 are configured to generate a sensor signal in response to a detected location and/or trajectory of a moving vehicle in the road 70, such as in the encroachment zone 90 and/or the safety zone 80. The encroachment zone 90 is a region adjacent the safety zone 80 in which vehicles are at risk of entering the safety zone 90. The encroachment zone 90 may include any region or area in which moving vehicles may be tracked for possible collisions, including "side-swiping" and/or impending rear collisions. Vehicles detected by the sensors 20, 22, 24 may include vehicles traveling in road 70, any areas beside the road 70 (e.g., the emergency lane or shoulder). Therefore, the system 10 may track or detect moving vehicles that exhibit any likelihood of entering the safety zone 90 or impacting the vehicle 28, e.g., in a direct line of sight rear collision/impact from behind the vehicle 28, moving vehicles that deviate from the lanes toward the rear of the vehicle 28, moving vehicles that show a likelihood of side-swiping or driving too close to the vehicle and the like.

The control unit 30 may be configured to receive the signal from the sensors 20, 22, 24 and to determine, responsive to the sensor signals, a likelihood of a moving vehicle entering the safety zone 80. The control unit 30 may also be configured to generate a trigger signal if the likelihood of the moving vehicle entering the safety zone is greater than a predetermined threshold. The alert unit 40 is configured to receive the trigger signal from the control unit 30 and to automatically trigger an alarm protocol when the trigger signal is received to alert the user in or near the safety zone 80. The alarm protocol may include initiating an alarm, such as an audible and/or visual alarm to alert a user in or near the safety zone 80 (for example, a police officer standing adjacent a nearby parked car) that a vehicle is likely to enter the safety zone 80. In some embodiments, the safety zone 80 extends a fixed distance from the vehicle 28. For example, the alarm protocol may be triggered when another vehicle is likely to enter the safety zone 80 in a lane of traffic near the vehicle 28. The visual and/or audible alarms may be integrated with the alarm unit 40, provided separately, and/or mounted on the vehicle 28.

In some embodiments, the sensor 24 is a LIDAR sensor and is configured to detect a direction and/or trajectory of another vehicle. For example, a LIDAR sensor may perform a 180 degree single plain scan at about 5,000 to 50,000 laser pulses per second in a scanning array. The data points reflect a moving object as grouped data points based on an x, y, z coordinate grid. The data from a LIDAR sensor may be compiled in a data display, for example, as provided as part of the control unit 30 and may show the front and partial side of a vehicle as it approaches the parked emergency vehicle 28 from the rear. The data collected may be used to determine the lanes vehicles are traveling in with a reference point of the left rear bumper of the parked vehicle 28. In some embodiments, the user may calibrate the lanes of traffic to the location of the vehicle 28; however, the control unit 30 may include data related to the likely location of lanes when the vehicle 28 is on the side of the road, and therefore, the location of the lanes may be estimated. In some embodiments, data from the LIDAR sensor itself may be used to establish the location of the lanes based on a sensed traffic pattern that generally defines the lanes.

A LIDAR sensor and/or other sensors may be used to determine a velocity, distance, trajectory and/or probable future course of travel for a vehicle in a traffic lane traveling toward the vehicle 28. If the vehicle is traveling or projected to travel in a non-established travel lane based on various predefined parameters and/or accepted threshold values, the warning or alarm protocol may be triggered by a trigger signal to the alarm unit 40. In some embodiments, different sensed positions may trigger different alarm protocols that may be selected by the alarm unit 40. For example, one alarm protocol may indicate a possible sideswiping incident from an oncoming vehicle, and another alarm protocol may indicate a possible rear collision. In addition, the sensor data may determine near-miss conditions based on a reference point, such as about eight feet from the side of the vehicle 28 and having a velocity greater than a predefined threshold or a threshold based on an established speed limit for the road.

The control unit 30 may also be configured to determine, responsive to the sensor signals, whether a moving vehicle has actually entered the safety zone 80. The control unit 30 may generate another trigger signal when a moving vehicle has entered the safety zone 80. The enforcement unit 50 may receive the trigger signal from the control unit 30 and automatically trigger an enforcement protocol when the trigger signal is received. For example, the enforcement protocol may automatically identify the vehicle that has entered the safety zone 80, such as by using a video camera or still camera that is configured to capture an image of the vehicle. The speed the vehicle is traveling may also be recorded and this information may be used to automatically generate a traffic citation based on the evidence from the sensor and/or enforcement unit 50. Moving vehicles having a speed greater than a predefined threshold and/or a distance from the vehicle 28 that is less than a predefined threshold may be flagged as possible or actual violators, for example, of speeding and/or "move over" laws that require a certain distance from parked official vehicles.

In some embodiments, the sensors 20, 22 are optical sensors that may be configured to detect when a vehicle enters the safety zone 80. The sensors 20, 22 may be spaced apart by a distance that is suitable to detect a speed at which a vehicle is moving based on a difference in the time at which the vehicle is detected by the sensors 20, 22. In some embodiments. In particular embodiments, the sensors 20, 22 are Class 2 lasers and may have a frequency of about 750 Hz.

Although embodiments according to the present invention are described with respect to the sensors 20, 22 24, it should be understood that any suitable configuration of sensors may be used. As illustrated in FIG. 1, the sensors 20, 22, 24 are mounted on the one side of the vehicle; however, one or more of the sensors 20, 22, 24 may be provided on both the right and left side of the vehicle 28, for example, for ease of use during traffic stops on either the right or left side of the road. In particular embodiments, a single LIDAR sensor 24 may be used for motion tracking, and the optical sensors 20, 22 may be provided on both the right and the left side of the vehicle 28 for a total of four optical sensors for detecting the motion and/or the speed of vehicles during traffic stops on either the right or the left side of a road. FIG. 1 illustrates a LIDAR sensor 24 that may be used primarily for tracking oncoming vehicles for triggering alarm protocols, and optical sensors 20, 22 that may be used primarily for detecting a vehicle in the safety zone 80 for triggering enforcement protocols. Thus, the sensors may be generally referred to as alarm sensors that are configured to determine a likelihood of a vehicle entering the safety zone, and enforcement sensors that are configured to detect actual entry of the safety zone and violation of other traffic laws. In some embodiments, however, the data from the alarm sensors and the enforcement sensors may be cross-correlated to determine, for example, feedback to better predict whether the threshold values for predicting violation of the safety zone 80 match actual data tracking actual violations of the safety zone 80 by the enforcement sensors. However, it should be understood that any suitable sensor(s) may be used, and the resulting data used for either or both alarm triggering and/or safety zone enforcement. Sensors that may be used include any suitable combination of one or more optical and/or tracking sensors, RADAR, cameras, any suitable imaging sensors, Doppler technology, wave millimeter devices, and/or multi-scanning LIDAR. Moreover, the sensors may be provided as part of a separate system and mounted on a vehicle or other stationary object, such as an object near a transportation worker construction team or emergency personnel. The safety zone 80 and/or sensors 20, 22, 24 may be modified or custom configured to accommodate any personnel or work configurations, such as transportation worker construction teams in which the safety zone 80 may be extended to cover a work area and/or additional sensors may be added. In some embodiments, the sensors are integrated as part of an emergency vehicle. In particular embodiments, the sensors are mounted at about two feet or between eighteen and thirty-six inches from the ground. Time-stamping and other data collection techniques may be used to correlate the data with actual events.

In some embodiments, data from the control unit 30 or other elements of the system 10 may be communicated to a network 60, and the data may be analyzed and/or compiled by other processing units, e.g., to issue traffic citations and/or compile statistics regarding a likelihood of collisions or near collisions at various locations.

Figure 2:
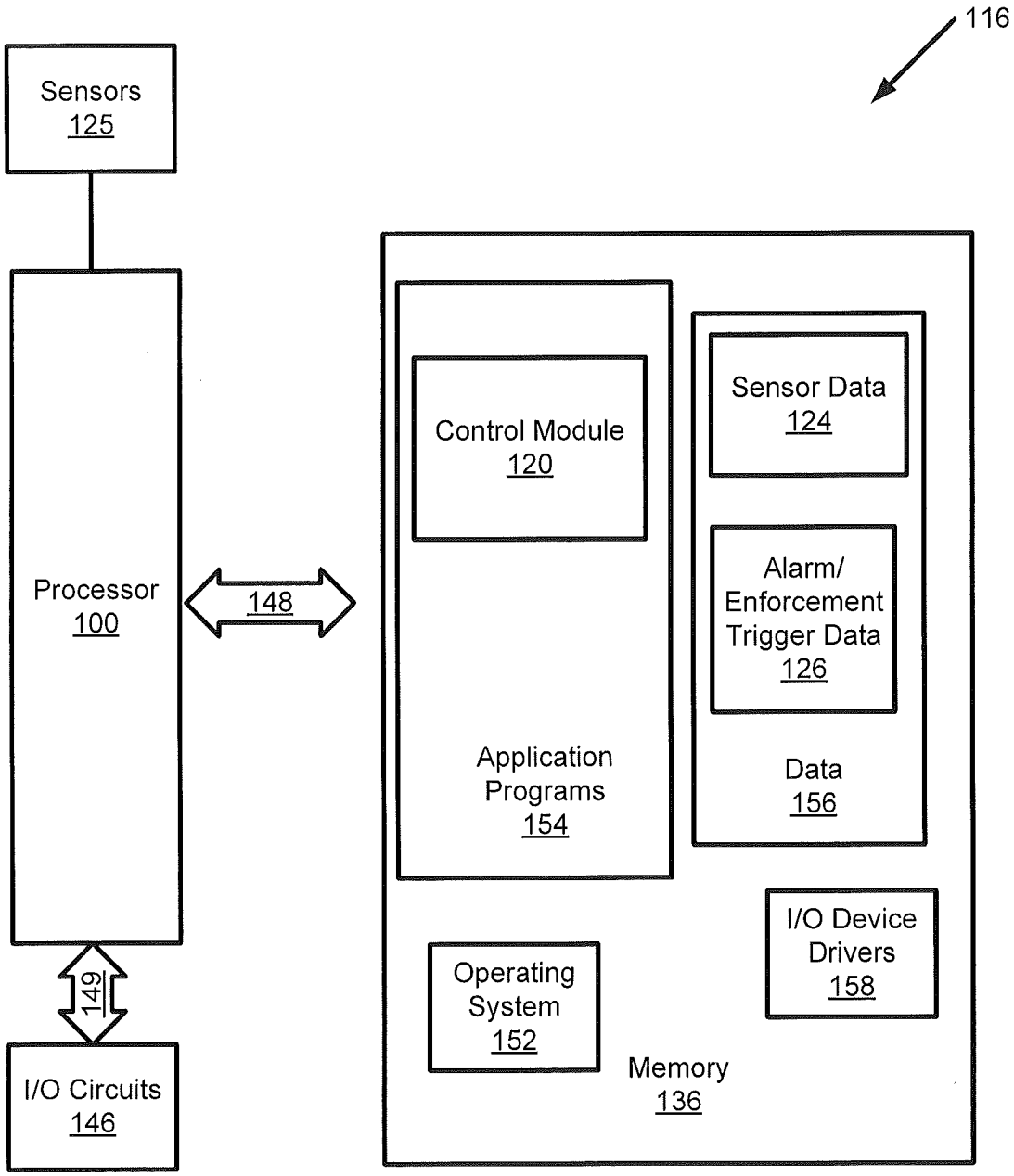
FIG. 2 is a schematic diagram of methods, systems and computer program products according to some embodiments.

FIG. 2 illustrates an exemplary data processing system that may be included in devices operating in accordance with some embodiments of the present invention, e.g., to carry out the operations described herein with respect to the system 10 in FIG. 1. As illustrated in FIG. 2, a data processing system 116, which can be used to carry out or direct operations includes a processor 100, a memory 136 and input/output circuits 146. The data processing system can be incorporated in a portable communication device and/or other components of a network, such as a server. The processor 100 communicates with the memory 136 via an address/data bus 148 and communicates with the input/output circuits 146 via an address/data bus 149. The input/output circuits 146 can be used to transfer information between the memory (memory and/or storage media) 136 and another component, such as a sensors 125 (e.g., motion or position detection sensors). These components can be conventional components such as those used in many conventional data processing systems, which can be configured to operate as described herein.

In particular, the processor 100 can be a commercially available or custom microprocessor, microcontroller, digital signal processor or the like. The memory 136 can include any memory devices and/or storage media containing the software and data used to implement the functionality circuits or modules used in accordance with embodiments of the present invention. The memory 136 can include, but is not limited to, the following types of devices: cache, ROM, PROM, EPROM, EEPROM, flash memory, SRAM, DRAM, magnetic disk, and Solid State Drives (SSD). In some embodiments of the present invention, the memory 136 can be a content addressable memory (CAM).

As further illustrated in FIG. 2, the memory (and/or storage media) 136 can include several categories of software and data used in the data processing system: an operating system 152; application programs 154; input/output device circuits 146; and data 156. As will be appreciated by those of skill in the art, the operating system 152 can be any operating system suitable for use with a data processing system, such as IBM®, OS/2®, AIX® or zOS® operating systems or Microsoft® Windows® operating systems Unix, Linux™ or Android™. The input/output device circuits 146 typically include software routines accessed through the operating system 152 by the application program 154 to communicate with various devices. The application programs 154 are illustrative of the programs that implement the various features of the circuits and modules according to some embodiments of the present invention. Finally, the data 156 represents the static and dynamic data used by the application programs 154, the operating system 152 the input/output device circuits 146 and other software programs that can reside in the memory 136.

The data processing system 116 can include several modules, including a control module 120 and the like. The modules can be configured as a single module or additional modules otherwise configured to implement the operations described herein for detecting the position and/or trajectory of a moving vehicle or other object. The data 156 can include sensor data 124 and/or alarm/enforcement trigger data 126, for example, that can be used by the control module 120 to detect and/or analyze a sensor signal and/or to control the alarm unit 40 and/or the enforcement unit 50.

While the present invention is illustrated with reference to the control module 120, the sensor data 124, and alarm/enforcement data 126 in FIG. 2, as will be appreciated by those of skill in the art, other configurations fall within the scope of the present invention. For example, rather than being an application program 154, these circuits and modules can also be incorporated into the operating system 152 or other such logical division of the data processing system. Furthermore, while the control module 120 in FIG. 2 is illustrated in a single data processing system, as will be appreciated by those of skill in the art, such functionality can be distributed across one or more data processing systems. Thus, the present invention should not be construed as limited to the configurations illustrated in FIG. 2, but can be provided by other arrangements and/or divisions of functions between data processing systems. For example, although FIG. 2 is illustrated as having various circuits and modules, one or more of these circuits or modules can be combined, or separated further, without departing from the scope of the present invention. In some embodiments, the operating system 152, programs 154 and data 156 may be provided as an integrated part of the sensors 125 and/or the alarm unit 40 and/or the enforcement unit 50.

Figure 3:
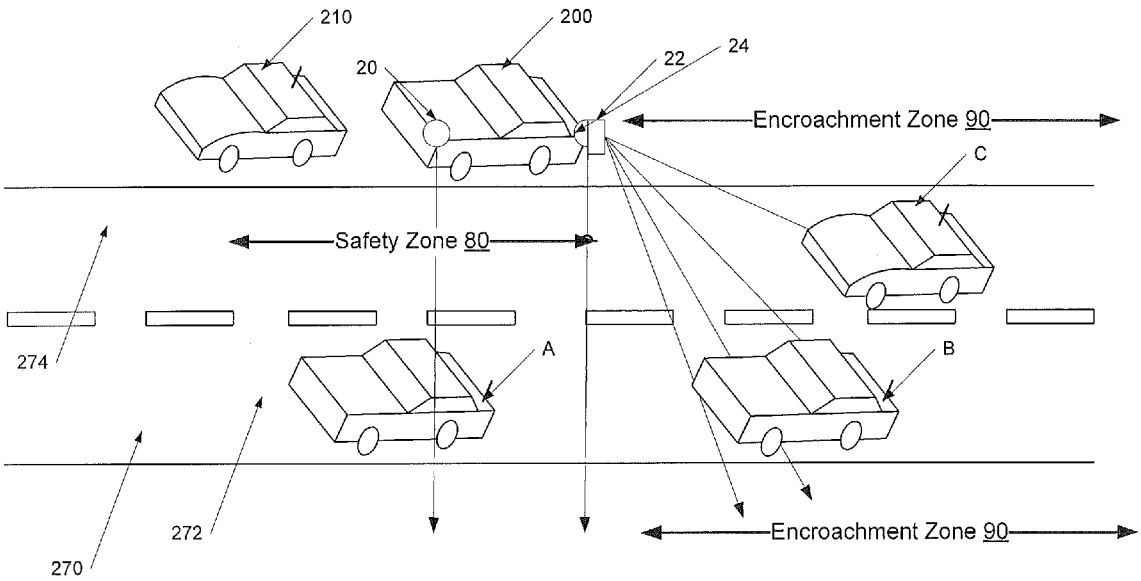
FIGS. 3-4 are schematic diagrams illustrating the system of FIG. 1 in use on a highway.
Figure 4:
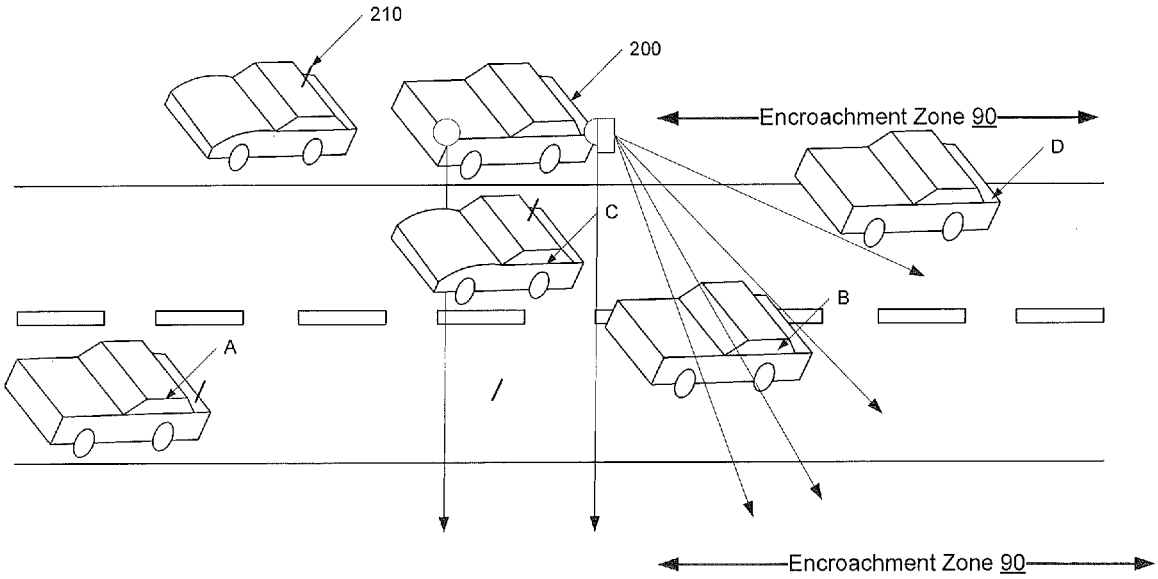

Various exemplary scenarios of vehicle movements and corresponding alarm/enforcement protocols will now be described with respect to FIGS. 3-4. As illustrated in FIGS. 3-4, a patrol car 200 is stopped by a road 270 having two lanes 272, 274 and is adjacent a civilian vehicle 210 as is typical when a patrol officer pulls another vehicle over to the side of the road for a traffic violation. As illustrated, FIG. 3 shows the positions of three vehicles A, B, C, D at a first time and FIG. 4 shows the positions of the vehicles A, B, C at a second time that is after the first time shown in FIG. 3. Vehicle A has maintained its position in the far lane 272 between FIGS. 3-4 as required by typical "move over" laws designed to protect police officers. Vehicle B is in the correct far lane 272 at the time depicted in FIG. 3; however, in FIG. 4, vehicle B illustrates a trajectory that is moving towards the near lane 274. In some embodiments, the sensor 24 detects a high probability of the vehicle B moving into the safety zone 80 adjacent the vehicles 200, 210 and initiates the alarm protocols discussed above, such as recording an image of the vehicle B for issuing a traffic citation. The vehicle C illustrates a high probability of entering the safety zone 80 in FIG. 3 and may also activate the alarm protocols discussed above. In addition, in FIG. 4, the vehicle C has actually entered the safety zone 80 and may be in violation of applicable "move over" laws. Thus, one or more of the signals from the sensors 20, 22, 24 may meet predefined thresholds for detecting a vehicle in the safety zone 80 and the enforcement protocols may be activated as discussed above. As illustrated in FIG. 4, an additional vehicle D has entered the encroachment zone 90 and is veering off of the lane 274. The vehicle D may therefore present a risk of a rear collision with the vehicle 200 and may trigger alarm and/or enforcement protocols discussed above.

It should be understood that the scenarios described above are non-limiting examples and that other safety zone configurations and/or vehicle movements may be used to trigger enforcement and/or alarm protocols according to some embodiments.

Figure 5:
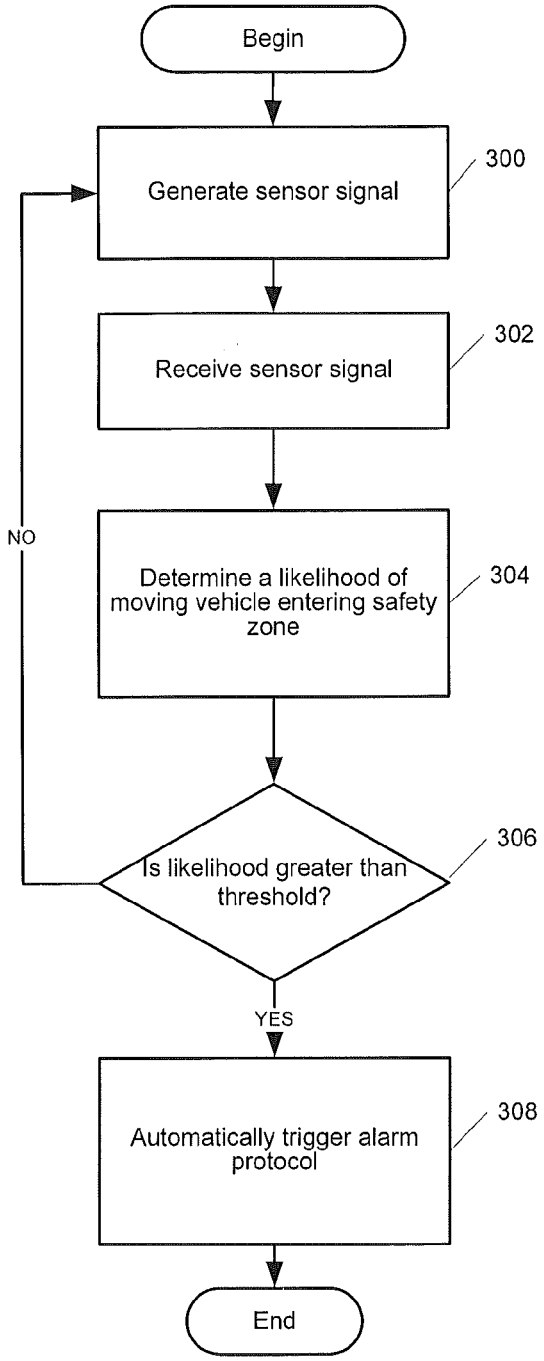
FIGS. 5-6 are flowcharts illustrating operations according to some embodiments.
Figure 6:
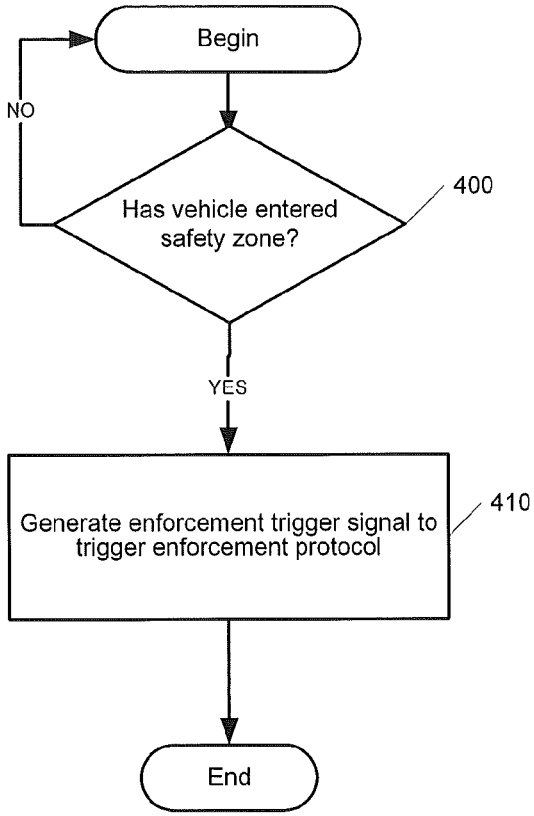

As illustrated in FIG. 5, methods according to some embodiments include generating a sensor signal from one or more sensors in response to a detected location and/or trajectory of a moving vehicle in an encroachment zone and/or the safety zone (Block 300). The encroachment zone is a region adjacent the safety zone in which vehicles are at risk of entering the safety zone. The sensor signal is received from the one or more sensors at a control unit (Block 302). A likelihood of the moving vehicle entering the safety zone is determined responsive to the sensor signal (Block 304). If the likelihood of the moving vehicle entering the safety zone is greater than a predetermined threshold, a trigger signal is generated and/or the alarm protocol is triggered, for example, by an alarm unit as described herein (Block 306). As shown in FIG. 6, in some embodiments, if the vehicle has entered the safety zone (Block 400), then an enforcement trigger is generated and/or an enforcement protocol is initiated, for example, by an enforcement unit as described herein (Block 410).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A system for alerting a user in a safety zone adjacent a stationary vehicle, the system comprising:

one or more sensors configured to generate a sensor signal in response to a detected location and/or trajectory of a moving vehicle in an encroachment zone and/or the safety zone, wherein the encroachment zone is a region adjacent the safety zone in which vehicles are at risk of entering the safety zone;

a control unit configured to receive the signal from the one or more sensors and to determine, responsive to the sensor signals, a likelihood of the moving vehicle entering the safety zone, wherein the control unit is further configured to generate a trigger signal if the likelihood of the moving vehicle entering the safety zone is greater than a predetermined threshold; and an alarm unit configured to receive the trigger signal from the control unit and to automatically trigger an alarm protocol when the trigger signal is received to alert the user in the safety zone, wherein the sensors comprise at least two spaced-apart optical sensors, and the sensor signals comprise a velocity of the moving vehicle based on a time that the vehicle is detected by each of the two spaced-apart optical sensors.

2. The system of claim 1, wherein the sensors are mounted on the stationary vehicle.

3. The system of claim 1, wherein the sensors comprise a LIDAR sensor configured to track an object.

4. The system of claim 1, wherein the alarm unit comprises an auditory and/or visual alarm.

5. The system of claim 1, wherein the trigger signal comprises an alarm trigger and the control unit is further configured to determine, responsive to the sensor signals, whether the moving vehicle has entered the safety zone, and to generate an enforcement trigger signal when the moving vehicle has entered the safety zone.

6. The system of claim 5, further comprising an enforcement unit configured to receive the enforcement trigger signal from the control unit and to automatically trigger an enforcement protocol when the enforcement trigger signal is received.

7. A system for alerting a user in a safety zone adjacent a stationary vehicle, the system comprising:

one or more sensors configured to generate a sensor signal in response to a detected location and/or trajectory of a moving vehicle in an encroachment zone and/or the safety zone, wherein the encroachment zone is a region adjacent the safety zone in which vehicles are at risk of entering the safety zone;

a control unit configured to receive the signal from the one or more sensors and to determine, responsive to the sensor signals, a likelihood of the moving vehicle entering the safety zone, wherein the control unit is further configured to generate a trigger signal if the likelihood of the moving vehicle entering the safety zone is greater than a predetermined threshold; and an alarm unit configured to receive the trigger signal from the control unit and to automatically trigger an alarm protocol when the trigger signal is received to alert the user in the safety zone, wherein the trigger signal comprises an alarm trigger and the control unit is further configured to determine, responsive to the sensor signals, whether the moving vehicle has entered the safety zone, and to generate an enforcement trigger signal when the moving vehicle has entered the safety zone, the device further comprising an enforcement unit configured to receive the enforcement trigger signal from the control unit and to automatically trigger an enforcement protocol when the enforcement trigger signal is received, wherein the enforcement unit is configured to record an identity of a vehicle when the enforcement protocol is triggered by the control unit.

8. The system of claim 7, wherein the enforcement protocol comprises recording a video including a license plate of the moving vehicle.

9. The system of claim 7, wherein the sensors comprise at least two spaced-apart optical sensors, and the sensor signal further comprises a velocity of the moving vehicle based on a time that the vehicle is detected by each of the two spaced-apart optical sensors.

10. A system for enforcing a safety zone adjacent a stationary vehicle, the system comprising:

one or more sensors configured to generate a sensor signal in response to a detected location and/or trajectory of a moving vehicle in an encroachment zone and/or the safety zone, wherein the encroachment zone is a region adjacent the safety zone in which vehicles are at risk of entering the safety zone;

a control unit configured to receive the signal from the one or more sensors and to determine, responsive to the sensor signals, whether the moving vehicle has entered the safety zone, wherein the control unit is further configured to generate a trigger signal when the moving vehicle has entered the safety zone; and an enforcement unit configured to receive the trigger signal from the control unit and to automatically trigger an enforcement protocol when the trigger signal is received, wherein the trigger signal comprises an enforcement trigger and the control unit is further configured to determine a likelihood of the moving vehicle entering the safety zone, wherein the control unit is further configured to generate an alarm trigger signal if the likelihood of the moving vehicle entering the safety zone is greater than a predetermined threshold.

11. The system of claim 10, wherein the sensors are mounted on the stationary vehicle.

12. The system of claim 10, wherein the sensors comprise at least two spaced-apart optical sensors, and the sensor signal further comprises a velocity of the moving vehicle based on a time that the vehicle is detected by each of the two spaced-apart optical sensors.

13. The system of claim 10, further comprising an alarm unit configured to receive the trigger signal from the control unit and to automatically trigger an alarm protocol when the trigger signal is received to alert the user in the safety zone.

14. The system of claim 13, wherein the alarm unit is configured to visually and/or audibly alert a user.

15. The system of claim 10, wherein the sensors comprise a LIDAR sensor configured to track an object.

16. A method for alerting a user in a safety zone adjacent a stationary vehicle, the method comprising:

generating a sensor signal from at least two spaced-apart optical sensors in response to a detected location and/or trajectory of a moving vehicle in an encroachment zone and/or the safety zone, wherein the encroachment zone is a region adjacent the safety zone in which vehicles are at risk of entering the safety zone;

receiving the sensor signal from the at least two spaced-apart optical sensors at a control unit;

determining a velocity of the moving vehicle based on a time that the vehicle is detected by each of the two spaced-apart optical sensors;

determining, responsive to the sensor signal, a likelihood of the moving vehicle entering the safety zone;

generating a trigger signal if the likelihood of the moving vehicle entering the safety zone is greater than a predetermined threshold; and automatically triggering at least one of an alarm protocol and/or an enforcement protocol when the trigger signal is received by an alarm unit and/or an enforcement unit to alert the user in the safety zone and/or enforce the safety zone.

17. The method of claim 16, wherein the trigger signal comprises an alarm trigger signal, the method further comprising:

determining, responsive to the sensor signals, whether the moving vehicle has entered the safety zone; and generating an enforcement trigger signal when the moving vehicle has entered the safety zone.

18. The method of claim 17, further comprising:

receiving the enforcement trigger signal at an enforcement unit; and automatically triggering an enforcement protocol when the enforcement trigger signal is received.

* * * * *